US005186850A

United States Patent [19]

Okorodudu et al.

[11] Patent Number: 5,186,850

[45] Date of Patent: Feb. 16, 1993

[54] MULTIFUNCTIONAL ASHLESS DISPERSANTS DERIVED FROM MANNICH REACTION OF ALKYL- OR ALKENYLSUCCINIMIDES, DIMERCAPTOTHIADIAZOLES, AND CARBONYL COMPOUNDS

[75] Inventors: Abraham O. M. Okorodudu, West Deptford; Angeline B. Cardis, Florence; Ross A. Kremer, Ringoes, all of N.J.

[73] Assignee: Mobil Oil Corporation, Fairfax, Va.

[21] Appl. No.: 910,923

[22] Filed: Jul. 9, 1992

[51] Int. Cl.[5] ..... C10M 135/36

[52] U.S. Cl. ..... 252/47.5; 252/402; 252/391; 548/127; 548/129; 548/130; 548/135; 548/142

[58] Field of Search ..... 252/47.5, 51.5 A, 402, 252/391; 548/142, 127, 129, 130, 135

[56] References Cited

U.S. PATENT DOCUMENTS

| | | | |
|---|---|---|---|
| 4,764,298 | 8/1988 | Croudace | 252/47.5 |
| 4,908,144 | 3/1990 | Davis et al. | 252/47.5 |
| 5,026,865 | 6/1991 | Karol | 548/142 |
| 5,055,584 | 10/1991 | Karol | 548/142 |
| 5,138,065 | 8/1992 | Karol | 548/142 |

*Primary Examiner*—Jacqueline Howard
*Attorney, Agent, or Firm*—Alexander J. McKillop; Charles J. Speciale; Howard M. Flournoy

[57] ABSTRACT

The incorporation of the heterocyclic dimercaptothiadiazole functionality into the alkenylsuccinimide dispersant structures via the Mannich alkylaminomethylkation procedure provides a class of ashless nonphosphorus dispersants with multifunctional antiwear, antioxidant and corrosion inhibitor properties in lubricant compositions.

21 Claims, No Drawings

MULTIFUNCTIONAL ASHLESS DISPERSANTS DERIVED FROM MANNICH REACTION OF ALKYL- OR ALKENYLSUCCINIMIDES, DIMERCAPTOTHIADIAZOLES, AND CARBONYL COMPOUNDS

BACKGROUND OF THE INVENTION

1. Field of the Invention

This invention is directed to novel multifunctional ashless dispersants derived from Mannich reaction of alkyl or alkenyl succinimides, dimercaptothiadiazoles and carbonyl compounds and to lubricant compositions containing same.

2. Description of Related Art

Alkyl- or alkenylsuccinimides are well known in the art as ashless dispersants for lubricants and fuels. Their principal function in such applications is to prevent the deleterious sludge accumulation on engine parts. Because of today's hotter and faster running engines, the performance properties of ashless dispersants are being optimized to cope with the increased sludge formation resulting from enhanced thermal and oxidative degradation of lubricant formulations. The synergistic combination of the succinimide and the sulfur, nitrogen-containing heterocyclic dimercaptothiadiazole functionalities in the products of this invention provides ashless dispersants with additional multifunctional antioxidant, antiwear and potential metal passivator protection for lubricant compositions.

BRIEF SUMMARY OF THE INVENTION

This invention is more particularly directed to the Mannich alkylaminomethylation of alkenylsuccinimides as a means of incorporating the heterocyclic dimercaptothiadiazole functionality into the alkenylsuccinimides which provides non-phosphorus, ashless dispersants with multifunctional antioxidant, load-carrying and corrosion inhibitor properties n lubricant compositions.

This invention is also directed to lubricant compositions comprising the above referred to Mannich reaction products. Accordingly, the primary object of this application is to provide improved lubricant compositions comprising the novel multifunctional reaction products derived from the Mannich reaction of alkyl- or alkenylsuccinimides and dimercaptothiadiazoles.

DESCRIPTION OF PREFERRED EMBODIMENTS

1. Preparation of Succinimides

Dispersant alkyl- or alkenylsuccinimides are generally prepared by imidation of the corresponding anhydrides with polyamines, viz:

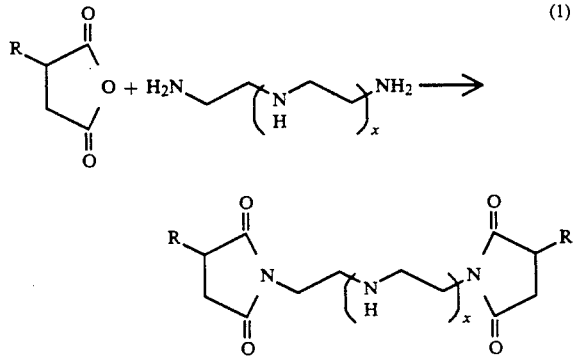

(1)

Mannich-type post reaction of the alkyl- or alkenylsuccinimides with dimercaptothiadiazole and carbonyl compounds in an organic solvent such as toluene, gives the reaction product of this invention as shown in Equation 2.

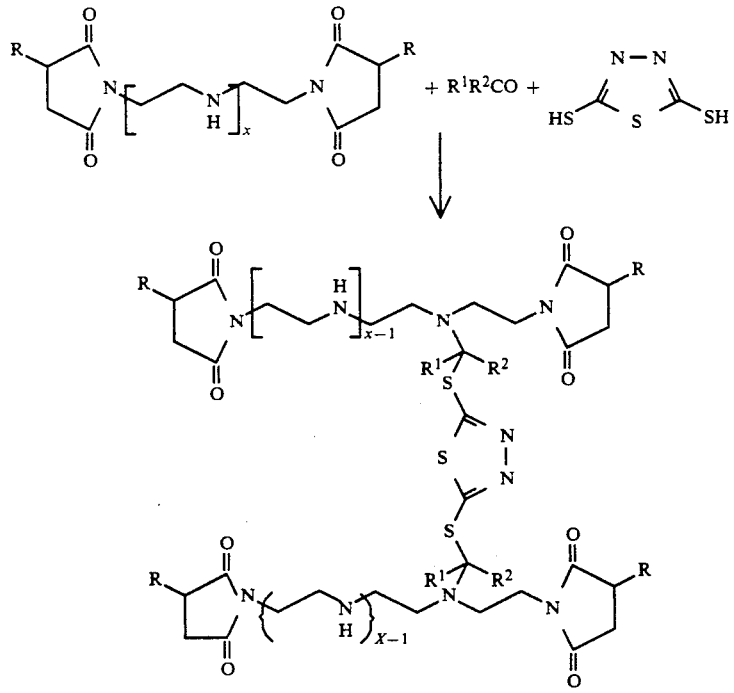

(2)

where R is $C_4$ to $C_{10,000}$ hydrocarbyl or hydrocarbenyl, and $R^1$ and $R^2$ may be the same or different and are hydrogen or $C_1$ to about $C_{300}$ hydrocarbyl, preferably $C_1$ to $C_{32}$, and where hydrocarbyl may be alkenyl, alkyl, aryl, aralkyl or alkaryl and optionally cyclic or polycyclic and where the hydrocarbyl moiety may optionally contain additional O, S or N, and X is an integer from 1 to about 30.

Although we do not wish to be bound by the structural formula of the reaction product of Equation 2, the resulting product is thought to contain material having such a structural formula. Hydrocarbyl as used herein is selected from the group consisting of alkyl, alkenyl, aryl, aralkyl, alkaryl and optionaly containing O, S, N, or mixtures thereof.

Any suitable succinimide may be used in the invention provided it contains at least one basic secondary amine. Preferred are those succinimides derived from polyisobutylene succinic anhydride and tetraethylenepentamine; and $C_{18}$–$C_{24}$ succinic anhydride and diethylenetriamine. The broad class of succinimides suitable for use here is particularly defined as the reaction product in Equation 1 above and more particularly be $C_4$ to about $C_{200}$ alkyl or alkenyl succinimides.

The polyamines suitable for use in preparing the succinimides include but ar not limited to polyamines such as tetraethylenepentaamine, and diethylene triamine.

Any suitable carbonyl compound may be used herein including aldehydes or ketones such as paraformaldehyde or 2-ethylhexanal.

Any suitable mercaptothiadiazole may be used such as 2,5-dimercapto-1,3,4-thiadiazole. Also highly suitable are mercaptobenzothiazoles.

Conditions for the above reactions may vary widely depending upon specific reactants, the presence or absence of a solvent and the like. Suitable solvents include but are not limited to hydrocarbon solvents such as xylene or toluene. Any suitable set of reaction conditions known to the art may be used. Generally, stoichiometric quantities of reactants are used. However, equimolar, more than molar or less than molar amounts may be used. The reactant carbonyl compounds can optionally contain additional O, N, S, etc. The reaction temperature may vary from ambient to about 250° C. or reflux, the pressure may be autogenous or may vary from ambient to about 10 psi and the molar ratio of reactant alkenyl succinimide, carbonyl compound and dimercaptothiadiazole preferably varies from about 2:2:1 moles to about 1:1:1 moles.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt. % based on the total weight of the composition can be used. Preferably, the concentration is from 0.1 to about 3 wt. %.

The additives have the ability to improve the above noted characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F. to about 6000 SSU at 100° F. and preferably, from about 50 to about 250 SSU at 210° F. These oils may have viscosity indexes preferably ranging to about 95. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any materials which is normally employed for thickening or gelling hydrocarbon fluids for foaming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes) and alkyl-substituted diphenyl ethers. Ester-based lubricants are highly suitable.

It is to be understood, however, that the compositions contemplated herein can also contain other materials. For example, corrosion inhibitors, extreme pressure agents, low temperature properties modifiers and the like can be used as exemplified respectively by metallic phenates sulfonates, polymeric succinimides, non-metallic or metallic phosphorodithioates and the like. These materials do not detract from the value of the compositions of this invention, rather the materials serve to impart their customary properties to the particular compositions in which they are incorporated.

The following examples illustrate but are not intended to limit the scope of this invention.

EXAMPLE 1

An alkenylsuccinimide (0.1 mole), (obtained from the post reaction of a 920 m.w. polyisobutylene succinic anhydride with tetraethylenepentaamine-TEPA), paraformaldehyde (0.1 mole), and 2,5-dimercapto-1,3,4-thiadiazole (0.05 moles) were charged into a 1-liter reaction flask equipped with a Dean-Stark trap. Xylene (200 ml) was added to this mixture which was then stirred and heated to reflux. Reflux was maintained for about 4 hours, during which time about 2 ml of water was collected. After stripping the solvent at reduced pressure, a quantitative yield of the product was obtained as a dark brown oil.

The reaction can be run with other polyamine-derived bis- or monoalkyl- or alkenylsuccinimides which contain at least one basic secondary amine, in other aprotic solvents such as hexanes, toluene, ethers, etc. Similarly, other carbonyl compounds such as ketones and aldehydes may be used. The reactant carbonyl compounds can optionally contain additional O, N, S, etc.

Following the procedure of Example 1, but varying the alkenylsuccinic anhydrides and/or the reactant carbonyl compounds, the products of the following examples were prepared in nearly quantitative yields.

EXAMPLE 2

The same reactants as in Example 1 except 2-ethylhexanal was the reactant carbonyl compound in the preparation of this product.

EXAMPLE 3

Following the procedure of Example 1 and using the same reactant ratios, the product of this reaction was prepared in essentially quantitative yield by using 2 equivalents each of an alkenylsuccinimide (obtained from the reaction of 560 m.w. polyisobutylenesuccinic anhydride with tetraethylenepentaamine-TEPA), 2-ethylhexanal and one equivalent of 2,5-dimercapto-1,3,4-thiadiazole.

EXAMPLE 4

This product was obtained from a $C_{18}$–$C_{24}$ alkenylsuccinimide (obtained from the reaction of a $C_{18}$–$C_{24}$ succinic anhydride with diethylenetriamine-DETA), paraformaldehyde and 2,5-dimercapto-1,3,4-thiadiazole in the molar ratios used in Example 1.

EXAMPLE 5

This product was obtained from a $C_{18}$–$C_{24}$ alkenylsuccinimide (obtained from the reaction of a $C_{18}$–$C_{24}$ succinic anhydride with diethylenetriamine-DETA), 2-ethylhexanal and 2,5-dimercapto-1,3,4-thiadiazole in the molar ratios used in Example 1.

EXAMPLE 6

This product was obtained from an alkenylsuccinimide (obtained from the reaction of a 920 m.w. polyisobutylenesuccinic anhydride with diethylenetriamine-DETA), paraformaldehyde and 2,5-dimercapto-1,3,4-thiadiazole in the same molar ratios as in Example 1.

EXAMPLE 7

This product was obtained by using an alkenylsuccinimide (obtained from the reaction of 560 m.w. polyisobutylenesuccinic anhydride with tetraethylenepentaamine-TEPA), paraformaldehyde and 2,5-dimercapto-1,3,4-thiadiazole in the same molar ratios as in Example 1.

EVALUATION OF PRODUCTS

The additives were blended (1%) into solvent refined paraffinic neutral base stock and tested for antioxidant effectiveness by Mobil Method 334-2 and in the industry-standard Four-Ball Wear Test machine for antiwear activity. The conditions of the tests, results and comparison of the above samples with base oils and commercial samples are show in Tables 1–3. Corrosivity test results in accordance with ASTM D130-6 are also disclosed in Table 1.

The Catalytic Oxidation Test reported in Tables 1 and 2 may be summarized as follows: Basically the lubricant is subjected to a stream of air which is bubbled through the oil formulation at the rate of five liters per hour at 325° F. for 40 hours or at 375° F. for 24 hours. Present in the composition are samples of metals commonly used in engine construction, namely iron, copper, aluminum and lead, see U.S. Pat. No. 3,682,980 incorporated herein by reference for further details of the test.

The Copper Strip Corrosivity Test (ASTM D-130) measures a product's propensity to corrode copper due to, for example, contained sulfur groups. Further details may be found in ASTM Standards on Petroleum Products and Lubricants, published annually by the American Society for testing Materials.

In the Four Ball Wear Test three stationary balls are placed in a lubricant cup and a lubricant containing the compound to be tested is added thereto, and a fourth ball is placed in a chuck mounted on a device which can be used to spin the ball at known speeds and loads. The examples were tested using half inch stainless steel balls of 52100 steel for thirty minutes under 60 kg load at 2000 rpm and 200° F. If additional information concerning this test is desired consult test method ASTM D2266 and/or U.S. Pat. No. 4,761,482.

K (as reported in Table 3), the wear coefficient, is calculated from the wear volume, V, of the stationary balls. The wear volume is calculated from the wear scar diameter D in mm as follows:

$$V=[15.5\ D3-0.0103\ L]\ D\times 10(-3)\ \text{mm3}$$

where L is the machine load in kg. This equation considers the elastic deformation of the steel balls.

Wear Coefficient K $$\text{Dimensionsless } K \text{ is defined as } K=\frac{VH}{dW}$$

where

V = wear volume, mm3

H = hardness 725 kg/mm2 for 52100 steel d = (23.3 mm/rev) (RPM × Time)

W = (0.408) (Load in kg)

TABLE 1

Catalytic Oxidation Test (M334-2)
40 Hrs. at 325° F.

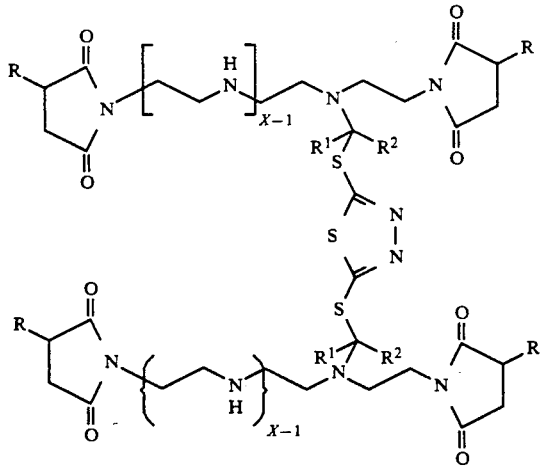

| Item | Additive (1% conc.) | % Viscosity Change (% ΔKV) | Change in Acidity (ΔNN) | Corrosivity, D130-6 |
|---|---|---|---|---|
| 1 | None (Base Oil, solvent refined paraffinic neutral mineral oil) | 246.1 | 14.8 | 1A |
| 2 | Proprietary Ashless Dispersant (underivatized bis succinimide) | 287.9 | 16.4 | 1A |
| 3 | Example 1: (item 2 derivatized) R = 920 m.w. PIB $R^1 = R^2 = H$; x = 3 | 58.4 | 6.5 | 1A |
| 4 | Example 2: (item 2 derivatized) R = 920 m.w. PIB $R^1 = H$; $R^2 = C_7H_{15}$; x = 3 | 61.4 | 8.3 | 1A |
| 5 | Example 3: R = 560 m.w. PIB $R^1 = H$; $R^2 = C_7H_{15}$; x = 3 | 53.1 | 4.8 | 1A |
| 6 | Example 4: R = $C_{18}$-$C_{24}$ $R^1 = R^2 = H$; x = 1 | 50.6 | 5.7 | 1A |
| 7 | Example 6: R = 920 m.w. PIB $R^1 = R^2 = H$; x = 1 | 56.9 | 4.8 | 1A |
| 8 | Example 7: R = 560 m.w. PIB $R^1 = R^2 = H$; x = 3 | 51 | 4.5 | 2A |

TABLE 2

Catalytic Oxidation Test (M334-10)
24 Hrs., 375°

| Item | Additive (4% conc.) | % Viscosity Change (% ΔKV) | Change in Acidity (ΔNN) |
|---|---|---|---|
| 1 | None (13 TBN Railroad Type Engine Oil) | 131.4 | 7.5 |
| 2 | Example 1: R = 920 m.w. PIB $R^1 = R^2 = H$; x = 3 | 49.1 | 4.6 |
| 3 | Example 2: R = 920 m.w. PIB $R^1 = H$; $R^2 = C_7H_{15}$; x = 3 | 47.5 | 4.6 |
| 4 | Example 3: R = 560 m.w. PIB $R^1 = H$; $R^2 = C_7H_{15}$; x = 3 | 44.5 | 11.2 |
| 5 | Example 4: R = $C_{18}$-$C_{24}$ $R^1 = R^2 = H$; x = 1 | 47.6 | 6.1 |
| 6 | Example 5: R = $C_{18}$-$C_{24}$ $R^1 = H$; $R^2 - C_7H_{15}$; x = 1 | 46.9 | 7.2 |
| 7 | Example 6: R = 920 m.w. PIB $R^1 = R^2 = H$; x = 1 | 44.7 | 7.6 |

TABLE 2-continued

Catalytic Oxidation Test (M334-10)
24 Hrs., 375°

| Item | Additive (4% conc.) | % Viscosity Change (% ΔKV) | Change in Acidity (ΔNN) |
|---|---|---|---|
| | $R^1 = R^2 = H$; x = 1 | | |

The above Tables show that the ashless dispersant Examples of this invention provide, in addition to dispersancy, very good antioxidant protection to the base lubricant composition as demonstrated by the control of viscosity and acidity. Table 1 further shows the superior performance of item 3 (Example 1) over its precursor, item 2, a proprietary ashless dispersant, clearly demonstrating the performance advantage provided by derivatizing the succinimide dispersants of this invention. Additionally, the corrosivity rating on this Table shows the metal surface passivator properties and the non-corrosive nature of the products of this invention.

TABLE 3

| Four-Ball Wear Test ½" Balls, 52100 Steel, 60 Kg, 2000 RPM, 200° F., 30 min. | | | |
|---|---|---|---|
| Item | Additive (1%) | Wear Scar Diam (mm) | K Factor |
| 1 | None (Base Oil) (80% solvent refined paraffinic bright oil, 20% solvent refined paraffinic neutral oil) | 1.49 | 266.1 |
| 2 | Proprietary Ashless Dispersant (Underivatized bis succinimide) | 1.74 | 496.6 |
| 3 | Example 1: (item #2 derivatized) R = 920 m.w. PIB $R^1 = R^2 = H$; x = 3 | 0.431 | 1.3 |
| 4 | Example 2: (item #2 derivatized) R = 920 m.w. PIB $R^1 = H$; $R^2 = C_7H_{15}$; x = 3 | 0.506 | 2.8 |
| 5 | Example 3: R = 560 m.w. PIB $R^1 = H$; $R^2 = C_7H_{15}$; x = 3 | 0.389 | 0.7 |
| 6 | Example 4: R = $C_{18}$–$C_{24}$ $R^1 = R^2 = H$; x = 1 | 0.414 | 1 |
| 7 | Example 5: R = $C_{18}$–$C_{24}$ $R^1 = H$; $R^2 = C_7H_{15}$; x = 1 | 0.414 | 1 |
| 8 | Example 6: R = 920 m.w. PIB $R^1 = R^2 = H$; x = 1 | 0.423 | 1.1 |
| 9 | Example 7: R = 560 m.w. PIB $R^1 = R^2 = H$; x = 3 | 0.478 | 2.2 |

The above Table shows that the ashless dispersant products of this invention also provide excellent antiwear protection to the lubricant composition, and again the superior performance of items 3 and 4 (Examples 1 and 2, respectively) over their precursor, item 2, a proprietary ashless dispersant, clearly demonstrates the beneficial effects of this chemistry.

Today's hotter running engines require more highly dispersant oil formulations to minimize the increased sludge formation and deposits on engine parts. Consequently, in addition to increased dispersant activity, the ashless dispersants must be compatible with, and if possible, provide additional performance protection to, these oil compositions.

By incorporating antiwear and antioxidant functionalities into existing succinimide ashless dispersants, the chemistry of this invention has made it possible to optimize their effectiveness and also expand their application. This is especially significant in view of current and projected industry-wide efforts to minimize the concentration of, or replace, the zinc dithiophosphates (ZnDTP) which have, historically, provided the multifunctional antiwear and antioxidant protection to a large variety of lubricant formulations.

In addition, the ashless and non-phosphorus products of this invention do not contain any environmentally and toxicologically undesirable metals or other potentially undesirable materials. Furthermore, existing technology and reactant raw materials are available to facilitate the preparation and production of this class of additives.

What is claimed is:

1. An improved lubricant composition comprising a major proportion of an oil of lubricating viscosity or a grease prepared therefrom and a minor proportion of a non-phosphorus, ashless dispersant multifunctional antioxidant, load-carrying and corrosion inhibiting additive product of reaction prepared by (A) imidation of an anhydride with a polyamine to obtain the corresponding dispersant alkyl- or alkenylsuccinimide and (b) reacting in a Mannich-type post reaction, said succinimide with a dimercaptothiadiazole and a carbonyl compound to obtain the desired additive product of reaction.

2. The composition of claim 1 wherein said desired additive product of reaction is generally prepared as described below:

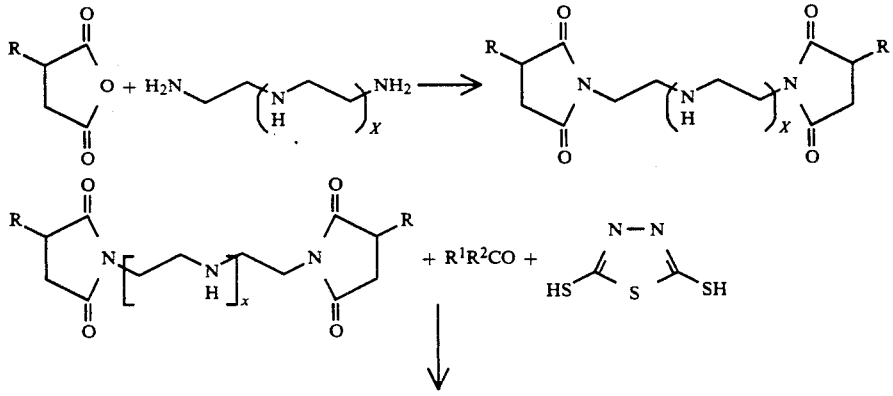

-continued

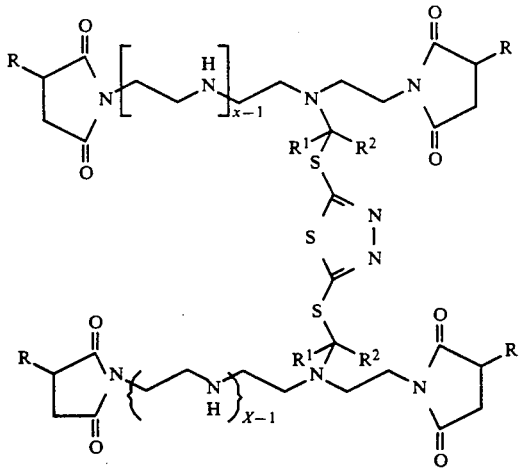

where R is $C_4$ to $C_{10,000}$ hydrocarbyl or hydrocarbenyl, and $R^1$ and $R^2$ may be the same or different and are hydrogen or $C_1$ to about $C_{300}$ hydrocarbyl and X is an integer from 1 to about 30 and wherein the reaction is carried out at temperatures varying from ambient to about 250° C. or reflux under autogenous pressures or pressures varying from ambient to about 10 psi for a time sufficient to obtain the desired additive product of reaction and where the reaction is carried out in molar ratios of reactants varying from equimolar to more than molar to less than molar.

3. The composition of claim 1 wherein the reactants are 920 m.w. polyisobutylene succinic anhydride, tetraethylenepentamine, paraformaldehyde and 2,5-dimercapto-1,3,4-thiadiazole.

4. The composition of claim 1 wherein the reactants are 920 m.w. polyisobutylene succinic anhydride, tetraethylenepentamine, 2-ethylhexanal and 2,5-dimercapto-1,3,4-thiadiazole.

5. The composition of claim 1 wherein the reactants are a $C_{18}$–$C_{24}$ succinic anhydride, diethylenetriamine, paraformaldehyde and 2,5-dimercapto-1,3,4-thiadiazole.

6. The composition of claim 1 wherein the reactants are a $C_{18}$–$C_{24}$ succinic anhydride, diethylenetriamine, 2-ethylhexanal and 2,5-dimercapto-1,3,4-thiadiazole.

7. The composition of claim 1 wherein the reactants are 920 m.w. polyisobutylene succinic anhydride, diethylenetriamine, paraformaldehyde, and 2,5-dimercapto-1,3,4-thiadiazole.

8. The composition of claim 1 wherein the reactants are 560 m.w. polyisobutylene succinic anhydride, tetraethylenepentamine, 2-ethylhexanal and 2, 5-dimercapto-1,3,4-thiadiazole.

9. The composition of claim 1 wherein the reactants are 560 m.w. polyisobutylene succinic anhydride, tetraethylenepentamine, paraformaldehyde, and 2,5-dimercapto-1,3,4-thiadiazole.

10. The composition of claim 1 wherein the lubricant is an oil of lubricating viscosity selected from the group consisting of (1) mineral oils, (2) synthetic oils, (3) or mixtures of mineral and synthetic oils or is (4) a grease prepared from any one of (1), (2) or (3).

11. The composition of claim 10 wherein the lubricant contains from about 0.001 to about 10 wt % based on the total weight of the composition of the additive product of reaction.

12. The composition of claim 10 wherein the lubricant is a mineral oil.

13. A process of preparing a non-phosphorus, ashless dispersant multifunctional antioxidant, load-carrying and corrosion inhibiting additive product prepared by (a) imidation of an anhydride with a polyamine to obtain the corresponding dispersant alkyl- or alkenylsuccinimide and (b) reacting in a Mannich-type post reaction said succinimide with a dimercaptothiadiazole and a carbonyl compound to obtain the desired additive product of reaction.

14. The process of claim 13 wherein said additive product is prepared as generally described below:

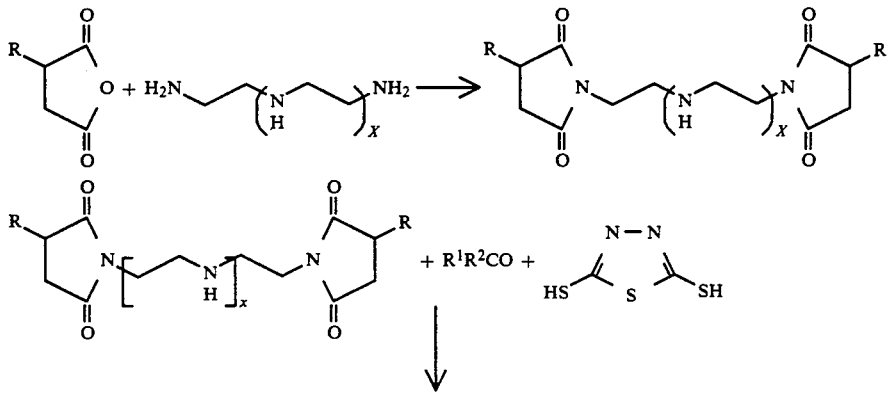

-continued

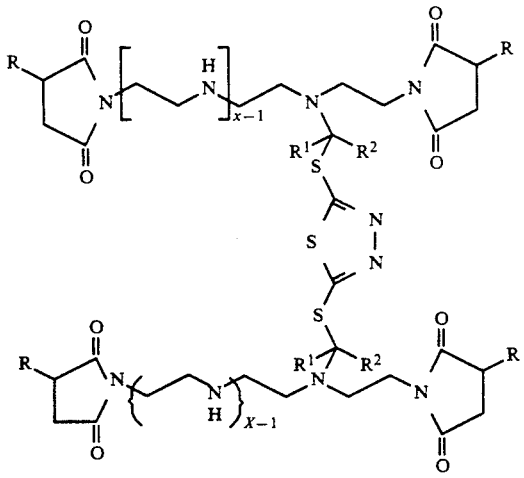

where R is $C_4$ to $C_{10,000}$ hydrocarbyl or hydrocarbenyl and $R^1$ and $R^2$ are hydrogen or $C_1$ to about $C_{300}$ hydrocarbyl, X is 1 to about 30 and wherein the reaction is carried out at temperatures varying from ambient to about 250° C. or reflux under pressures varying from ambient or autogenous for a time sufficient to obtain the desired additive product of reaction and where the reaction is carried out in molar ratios of reactants varying from equimolar to more than molar to less than molar.

15. The process of claim 13 wherein the reactants are polyisobutylene succinic anhydride, tetraethylenepentamine, paraformaldehyde and 2,5-dimercapto-1,3,4-thiadiazole.

16. The process of claim 13 wherein the reactants are polyisobutylene succinic anhydride, tetraethylenepentamine, 2-ethylhexanal and 2,5-dimercapto-1,3,4-thiadiazole.

17. The process of claim 13 wherein the reactants are a $C_{18}$–$C_{24}$ succinic anhydride, diethylenetriamine, paraformaldehyde and 2,5-dimercapto-1,3,4-thiadiazole.

18. The process of claim 13 wherein the reactants are a $C_{18}$–$C_{24}$ succinic anhydride, diethylenetriamine, 2-ethylhexanal and 2,5-dimercapto-1,3,4-thiadiazole.

19. The process of claim 13 wherein the reactants are polyisobutylene succinic anhydride, diethylenetriamine, paraformaldehyde, and 2,5-dimercapto-1,3,4-thiadiazole.

20. The process of claim 13 wherein the reactants are polyisobutylene succinic anhydride, diethylenetriamine, 2-ethylhexanal and 2, 5-dimercapto-1,3,4-thiadiazole.

21. A method of preparing an improved lubricant composition comprising adding to said lubricant a minor multifunctional antioxidant, load-carrying, corrosion-inhibiting amount of from about 0.001 to about 10 wt % based on the total weight of the composition of an additive product of reaction as described in claim 1.

* * * * *